US009728113B2

(12) United States Patent
Dai

(10) Patent No.: US 9,728,113 B2
(45) Date of Patent: Aug. 8, 2017

(54) CONTROL SIGNAL GENERATING CIRCUIT AND CIRCUIT SYSTEM

(71) Applicant: BOE TECHNOLOGY GROUP CO., LTD., Beijing (CN)

(72) Inventor: Qibing Dai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 289 days.

(21) Appl. No.: 14/429,172

(22) PCT Filed: Jun. 9, 2014

(86) PCT No.: PCT/CN2014/079508
§ 371 (c)(1),
(2) Date: Mar. 18, 2015

(87) PCT Pub. No.: WO2015/039463
PCT Pub. Date: Mar. 26, 2015

(65) Prior Publication Data

US 2016/0027352 A1 Jan. 28, 2016

(30) Foreign Application Priority Data

Sep. 17, 2013 (CN) ..... 2013 1 0424637

(51) Int. Cl.
*G09G 3/00* (2006.01)
*G09G 3/36* (2006.01)
(Continued)

(52) U.S. Cl.
CPC ..... *G09G 3/006* (2013.01); *G09G 3/3266* (2013.01); *G09G 3/3291* (2013.01);
(Continued)

(58) Field of Classification Search
CPC .... G09G 3/006; G09G 3/3696; G09G 3/3291; G09G 3/3674; G09G 3/3266;
(Continued)

(56) References Cited

U.S. PATENT DOCUMENTS

2002/0126077 A1* 9/2002 Baek ..... G09G 3/3611 345/87
2005/0068284 A1* 3/2005 Joo ..... G09G 3/3648 345/99
(Continued)

FOREIGN PATENT DOCUMENTS

CN 1664739 A 9/2005
CN 103297027 A 9/2013
(Continued)

OTHER PUBLICATIONS

International Search Report dated Jun. 9, 2014 corresponding to application No. PCT/CN2014/079508.
The First Office Action of CN201310424637.9 dated Nov. 14, 2014.

*Primary Examiner* — Temesghen Ghebretinsae
*Assistant Examiner* — Ivelisse Martinez Quiles
(74) *Attorney, Agent, or Firm* — Nath, Goldberg & Meyer; Joshua B. Goldberg; Christopher Thomas

(57) ABSTRACT

The present invention provides a control signal generating circuit, which comprises a signal output module comprising an output terminal, a first control signal input terminal and a second control signal input terminal, and the signal output module can selectively output the first control signal input from the first control signal input terminal or the second control signal input from the second control signal input terminal to a control signal receiving circuit via the output terminal. The present invention further provides a circuit system comprising the control signal generating circuit. When providing high-level signal and low-level signal for a control signal receiving circuit, the control signal generating
(Continued)

circuit of the present invention only needs to switch between first control signal mode and second control signal mode, without complicated conversion. In addition, the control signal generating circuit of the present invention can test various control signal receiving circuits which need quick action.

18 Claims, 3 Drawing Sheets

(51) Int. Cl.
*G09G 3/32* (2016.01)
*G09G 3/3266* (2016.01)
*G09G 3/3291* (2016.01)

(52) U.S. Cl.
CPC ..... *G09G 3/3674* (2013.01); *G09G 3/3677* (2013.01); *G09G 3/3696* (2013.01); *G09G 2300/0408* (2013.01); *G09G 2330/021* (2013.01); *G09G 2330/028* (2013.01)

(58) Field of Classification Search
CPC ..... G09G 3/3677; G09G 2330/028; G09G 2330/021; G09G 2300/0408
See application file for complete search history.

(56) References Cited

U.S. PATENT DOCUMENTS

2005/0184946 A1* 8/2005 Pyoun ..... G09G 3/3677 345/94
2006/0066531 A1* 3/2006 Park ..... G09G 3/3233 345/76
2007/0001978 A1* 1/2007 Cho ..... G09G 3/3655 345/98
2008/0309655 A1* 12/2008 Ito ..... H02M 3/07 345/211
2009/0021469 A1* 1/2009 Yeo ..... G02F 1/133603 345/102
2011/0080397 A1* 4/2011 Yamamoto ..... G09G 3/342 345/214
2015/0116300 A1* 4/2015 Yamaki ..... G02F 1/1368 345/212
2015/0279272 A1* 10/2015 Takahara ..... G09G 3/3233 345/76

FOREIGN PATENT DOCUMENTS

CN 103472753 A 12/2013
CN 203422916 U 2/2014
JP 2007114559 A 5/2007
JP 2007114682 A 5/2007

* cited by examiner

111

112

CONTROL SIGNAL GENERATING CIRCUIT AND CIRCUIT SYSTEM

This is a National Phase Application filed under 35 U.S.C. 371 as a national stage of PCT/CN2014/079508, filed Jun. 9, 2014, an application claiming the benefit of Chinese Application No. 201310424637.9, filed Sep. 17, 2013, the content of each of which is hereby incorporated by reference in its entirety.

FIELD OF THE INVENTION

The present invention relates to the field of control and testing technology for circuit, and particularly to a control signal generating circuit and a circuit system including the control signal generating circuit.

BACKGROUND OF THE INVENTION

In array substrates of display devices, gate driving circuits (GOAs, Gate-drivers On Array, i.e., gate driving circuits integrated on the array substrate) have been largely used. When a display panel is tested, testing of the gate driving circuits is an important part of the entire testing process. Control signals for the gate driving circuits include a high-level signal VGH (gate turn-on voltage) and a low-level signal VGL (gate turn-off voltage). In the prior art, a control signal generating circuit of the gate driving circuit mostly uses operational amplifiers to achieve conversion between the high-level signal VGH and the low-level signal VGL. However, when the gate driving circuit needs rapidly-changing control signals, such method of using operational amplifiers to provide control signals cannot meet the requirement.

Therefore, it has become a necessity to provide a control signal generating circuit for the gate driving circuit, which can achieve rapid conversion between the high-level signal and the low-level signal.

SUMMARY OF THE INVENTION

An object of the present invention is to provide a control signal generating circuit, which can achieve rapid conversion between a high-level signal and a low-level signal, and a circuit system including the control signal generating circuit.

In order to achieve the above object, as an aspect of the present invention, there is provided a control signal generating circuit, comprising a signal output module, which comprises an output terminal, a first control signal input terminal for receiving a first control signal and a second control signal input terminal for receiving a second control, wherein, the signal output module is able to selectively output the first control signal input from the first control signal input terminal or the second control signal input from the second control signal input terminal to a control signal receiving circuit via the output terminal.

Preferably, the signal output module further comprises a timing signal input terminal for receiving a timing signal, and the signal output module selectively outputs, according to the timing signal input from the timing signal input terminal, the first control signal input from the first control signal input terminal or the second control signal input from the second control signal input terminal to the control signal receiving circuit via the output terminal.

Preferably, the signal output module comprises at least one analog switch, each analog switch comprises the output terminal, the first control signal input terminal, the second control signal input terminal and the timing signal input terminal, and the output terminal is selectively connected to the first control signal input terminal or the second control signal input terminal according to the timing signal input from the timing signal input terminal.

Preferably, the control signal generating circuit further comprises a programmable logic device for generating the timing signal, and a timing signal output terminal of the programmable logic device is connected to the timing signal input terminal of the signal output module.

Preferably, the signal output module comprises a plurality of timing signal input terminals and a plurality of output terminals which are in one-to-one correspondence with the plurality of timing signal input terminals, the programmable logic device comprises a plurality of timing signal output terminals, which are respectively connected to the plurality of timing signal input terminals of the signal output module, and the plurality of timing signal output terminals of the programmable logic device are capable of outputting a plurality of timing signals.

Preferably, the control signal receiving circuit is a gate driving circuit of a display device, the signal output module comprises three timing signal input terminals, the plurality of timing signal output terminals of the programmable logic device comprise a first timing signal output terminal for outputting a first timing signal, a second timing signal output terminal for outputting a second timing signal and a third timing signal output terminal for outputting a third timing signal, the first timing signal is used for controlling the signal output module to output an initial signal, the second timing signal is used for controlling the signal output module to output a first clock signal, and the third timing signal is used for controlling the signal output module to output a second clock signal.

Preferably, the programmable logic device includes a field programmable gate array device, whose output pins serve as the timing signal output terminals.

Preferably, the control signal generating circuit further comprises a DC voltage conversion module, which comprises a first control signal output module for generating the first control signal and a second control signal output module for generating the second control signal, the first control signal output module is connected to the first control signal input terminal of the signal output module, and the second control signal output module is connected to the second control signal input terminal of the signal output module.

Preferably, the first control signal output module comprises a first DC voltage input terminal, a first DC voltage conversion chip and a first control signal output terminal, the first DC voltage input terminal is connected to a DC power supply, a DC voltage input via the first DC voltage input terminal forms the first control signal after converted by the first DC voltage conversion chip and electronic components connected with the first DC voltage conversion chip, and the first control signal is then output from the first control signal output terminal;

the second control signal output module comprises a second DC voltage input terminal, a second DC voltage conversion chip and a second control signal output terminal, the second DC voltage input terminal is connected to a DC power supply, a DC voltage input via the second DC voltage input terminal forms the second control signal after converted by the second DC voltage conversion chip and electronic components connected with the second DC voltage conversion chip, and the second control signal is then output from the second control signal output terminal.

Preferably, the control signal generating circuit comprises a plurality of DC voltage conversion modules, the signal output module comprises a plurality of sets of the first control signal input terminals and the second control signal input terminals, and the plurality of DC voltage conversion modules are in one-to-one correspondence with the plurality of sets of the first control signal input terminals and the second control signal input terminals of the signal output module, respectively.

Preferably, the first control signal output by the first control signal output module is adjustable in a first predetermined range; and/or the second control signal output by the second control signal output module is adjustable in a second predetermined range.

Preferably, the first predetermined range is from 5V to 20V, and the second predetermined range is from −20V to −5V.

As another aspect of the present invention, there is provided a circuit system, comprising a control signal generating circuit and a control signal receiving circuit, wherein the control signal generating circuit is the above control signal generating circuit provided by the present invention, and the output terminal of the signal output module of the control signal generating circuit is electrically connected to the control signal receiving circuit.

Preferably, the control signal receiving circuit is a gate driving circuit of a display device, the gate driving circuit comprises an initial signal input terminal, a first clock signal input terminal and a second clock signal input terminal, the signal output module of the control signal generating circuit is capable of providing an initial signal to the initial signal input terminal of the gate driving circuit, providing a first clock signal to the first clock signal input terminal of the gate driving circuit and providing a second clock signal to the second clock signal input terminal of the gate driving circuit.

When the control signal generating circuit provided by the present invention is used to provide the control signal receiving circuit with the first control signal and the second control signal which are necessary for control, the control signal generating circuit only needs to switch between the first control signal mode and the second control signal mode, and no complicated conversion is required (for example, there is no need to use operational amplifiers to switch between the first control signal and the second control signal). It can be seen that, since the control signal generating circuit provided by the present invention can switch rapidly between the first control signal mode and the second control signal mode, operational requirement that the control signal received by the control signal receiving circuit needs to rapidly switch between the first control signal and the second control signal can be satisfied.

BRIEF DESCRIPTION OF THE DRAWINGS

The accompanying drawings, constituting a part of the specification, are used for providing a further understanding of the present invention, and explaining the present invention in combination with the following specific implementations, rather than limiting the present invention. In the drawings.

REFERENCE NUMERALS

Figure 1:
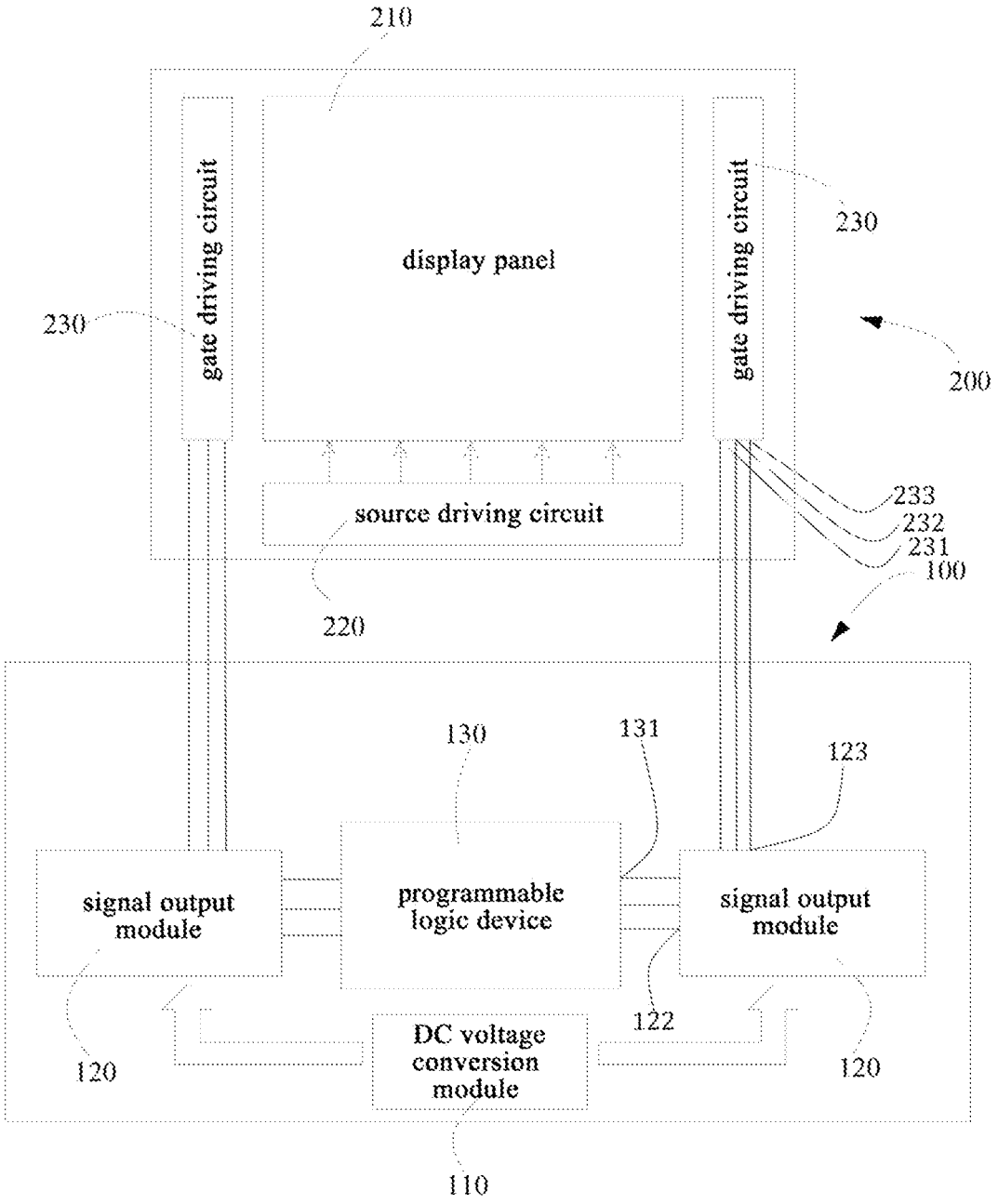
FIG. 1 is a schematic diagram of a control signal generating circuit and a display device provided by a specific implementation of the present invention.

100: control signal generating circuit
110: DC voltage conversion module
111: first control signal output module
112: second control signal output module
120: signal output module
121: analog switch
122: timing signal input terminal
123: output terminal
130: programmable logic device
131: timing signal output terminal
200: display device
210: display panel
220: source driving circuit
230: gate driving circuit
231: initial signal input terminal
232: first clock signal input terminal
233: second clock signal input terminal
121*a*: output terminal
121*b*: first control signal input terminal
121*c*: second control signal input terminal
121*d*: timing signal input terminal
111*a*: first DC voltage input terminal
111*b*: first control signal output terminal
111*c*: first DC voltage conversion chip
112*a*: second DC voltage input terminal
112*b*: second control signal output terminal
112*c*: second DC voltage conversion chip

DETAILED DESCRIPTION OF THE EMBODIMENTS

Specific implementations of the present invention will be described in detail below in conjunction with the accompanying drawings. It should be understood that, the specific implementations described herein are merely used for explaining and illustrating the present invention, rather than limiting the present invention.

As shown in FIG. 1, as an aspect of the present invention, there is provided a control signal generating circuit 100 comprising a signal output module 120, which comprises an output terminal 123, a first control signal input terminal for receiving a first control signal and a second control signal input terminal for receiving a second control. The signal output module 120 can selectively output the first control signal input from the first control signal input terminal or the second control signal input from the second control signal input terminal to a control signal receiving circuit via the output terminal 123.

The control signal that the control signal receiving circuit receives when operating normally needs to switch between the first control signal and the second control signal. The control signal generating circuit 100 provided by the present invention has two modes, i.e., a first control signal mode and a second control signal mode, and can switch between the two modes. Specifically, in the first control signal mode, the signal output module 120 outputs the first control signal input from the first control signal input terminal to the control signal receiving circuit; in the second control signal mode, the signal output module 120 outputs the second control signal input from the second control signal input terminal to the control signal receiving circuit.

The first control signal and the second control signal may be mutually different level signals. For example, the first control signal may be a low-level signal VGL, and the second control signal may be a high-level signal VGH, or vice versa. The control signal receiving circuit may be a gate driving circuit in a display device. The first control signal and the second control signal may be generated by existing components and are respectively output to the first control signal input terminal and the second control signal input terminal of the signal output module 120.

When the control signal generating circuit 100 provided by the present invention is used to provide the control signal receiving circuit with the first control signal and the second control signal which are necessary for control, all that is needed is to switch between the first control signal mode and the second control signal mode of the control signal generating circuit 100, and no complicated conversion is required (for example, there is no need to use operational amplifiers to switch between the first control signal and the second control signal). It can be seen that, since the control signal generating circuit 100 provided by the present invention can switch rapidly between the first control signal mode and the second control signal mode, operational requirement that the control signal received by the control signal receiving circuit needs to rapidly switch between the first control signal and the second control signal can be satisfied.

In addition, the control signal generating circuit 100 provided by the present invention can also be used for testing the control signal receiving circuit which demands rapid switch between the first control signal and the second control signal. That is to say, the control signal generating circuit 100 provided by the present invention can simulate working environment of the control signal receiving circuit (e.g., the gate driving circuit in the display device) more realistically, so as to test the control signal receiving circuit, thereby determining whether the control signal receiving circuit is a non-defective product or not.

In the present invention, the control signal generating circuit 100 can switch between the first control signal mode and the second control signal mode in a variety of ways. For example, the control signal generating circuit 100 may switch between the first control signal mode and the second control signal mode by mechanical means. Specifically, a timing unit may be provided in the control signal generating circuit 100, and the timing unit can function periodically to enable the control signal generating circuit 100 to switch between the first control signal mode and the second control signal mode periodically.

In order to improve switching speed of the control signal generating circuit 100 between the first control signal mode and the second control signal mode, preferably, the control signal generating circuit 100 may switch between the first control signal mode and the second control signal mode by electronic means. Specifically, the signal output module 120 may further comprise a timing signal input terminal 122 for receiving a timing signal. The signal output module 120 selectively outputs the first control signal input from the first control signal input terminal or the second control signal input from the second control signal input terminal to the control signal receiving circuit via the output terminal 123, according to the timing signal input from the timing signal input terminal 122. It should be understood that, timing of the timing signal input from the timing signal input terminal 122 of the signal output module 120 is synchronous with those of the control signals (i.e., the first control signal and the second control signal) required for normal operation of the control signal receiving circuit. The timing signal may be generated by existing components and is output to the timing signal input terminal 122 of the signal output module 120.

Figure 4:
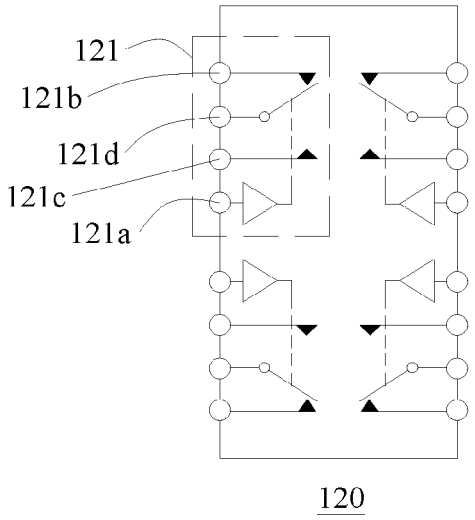
FIG. 4 is a circuit diagram of a signal output module provided by a specific implementation of the present invention.

In order to respond to the timing signal quickly, preferably, the signal output module 120 may further comprise at least one analog switch 121, each of which, as shown in FIG. 4, comprises an output terminal 121*a*, a first control signal input terminal 121*b*, a second control signal input terminal 121*c* and a timing signal input terminal 121*d*. The output terminal 121 is selectively connected to the first control signal input terminal 121*b* or the second control signal input terminal 121*c* according to the timing signal input from the timing signal input terminal 121*d*, so as to output the first control signal or the second control signal to the control signal receiving circuit correspondingly.

Specifically, when the timing signal input from the timing signal input terminal 121*d* is at a high level, the output terminal 121*a* of the analog switch 121 is connected to the first control signal input terminal 121*b*, so that the first control signal input from the first control signal input terminal 121*b* is output to the control signal receiving circuit via the output terminal 121*a*; when the timing signal input from the timing signal input terminal 121*d* is at a low level, the output terminal 121*a* of the analog switch 121 is connected to the second control signal input terminal 121*c*, so that the second control signal input from the second control signal input terminal 121*c* is output to the control signal receiving circuit via the output terminal 121*a*.

Alternatively, when the timing signal input from the timing signal input terminal 121*d* is at a low level, the output terminal 121*a* of the analog switch 121 is connected to the first control signal input terminal 121*b*, so that the first control signal input from the first control signal input terminal 121*b* is output to the control signal receiving circuit via the output terminal 121*a*; when the timing signal input from the timing signal input terminal 121*d* is at a high level, the output terminal 121*a* of the analog switch 121 is connected to the second control signal input terminal 121*c*, so that the second control signal input from the second control signal input terminal 121*c* is output to the control signal receiving circuit via the output terminal 121*a*.

When the signal output module 120 is provided with one output terminal, the signal output module 120 may be provided with one analog switch. In the specific implementation shown in FIG. 4, the signal output module 120 is provided with four analog switches, and thus the signal output module 120 is provided with four output terminals. The signal output module 120 provided with a plurality of analog switches 121 will be described in detail hereinafter, and is not described repeatedly here.

In the present invention, an external timing signal generating device may be used to provide the timing signal to the signal output module 120 of the control signal generating circuit 100. In order to improve integration level of the control signal generating circuit 100 and reduce total size of a circuit system including the control signal generating circuit 100, preferably, a programmable logic device 130 for generating the timing signal may be integrated within the control signal generating circuit 100, and a timing signal output terminal 131 of the programmable logic device 130 is connected to the timing signal input terminal 122 of the signal output module 120.

When the control signal receiving circuit needs a plurality of sets of control signals (each of which includes the first control signal and the second control signal) to operate normally, the control signal generating circuit 100 may comprise a plurality of signal output modules 120, each of which is provided with one output terminal. In order to improve integration level of the control signal generating circuit 100, preferably, the control signal generating circuit 100 may comprise only one signal output module 120, which may comprise a plurality of output terminals. For example, the signal output module 120 may comprise a plurality of analog switches 121, each of which is provided with one output terminal 121*a*, and in this way, the signal output module 120 is provided with a plurality of output terminals.

Since each set of control signals required for normal operation of the control signal receiving circuit includes the first control signal and the second control signal, when the signal output module 120 is provided with a plurality of output terminals 123, the signal output module 120 may also comprise a plurality of timing signal input terminals 122, which are in one-to-one correspondence with the plurality of output terminals 123. Accordingly, the programmable logic device 130 comprises a plurality of timing signal output terminals 131, which are respectively connected to the plurality of timing signal input terminals 122 of the signal output module 120, and a plurality of timing signals can be output from the plurality of timing signal output terminals 131 of the programmable logic device 130.

It can be understood by a person skilled in the art that, timings of the sets of control signals (each set of control signals include the first control signal and the second control signal) may be the same, or may be different, and thus the plurality of timing signals output from the plurality of timing signal output terminals 131 of the programmable logic device 130 may be the same, or may be different from each other, as long as timings of the plurality of timing signals synchronize with those of the respective sets of control signals required for operation of the control signal receiving circuit, respectively.

Different types of control signal receiving circuits need different control signals. For example, when the control signal receiving circuit is a gate driving circuit of a display panel, three sets of control signals, i.e., an initial signal STV (including a low-level signal and a high-level signal), a first clock signal CLK1 (including a low-level signal and a high-level signal) and a second clock signal CLK2 (including a low-level signal and a high-level signal), serve as the control signals required for operation of the control signal receiving circuit which is the gate driving circuit.

Figure 5:
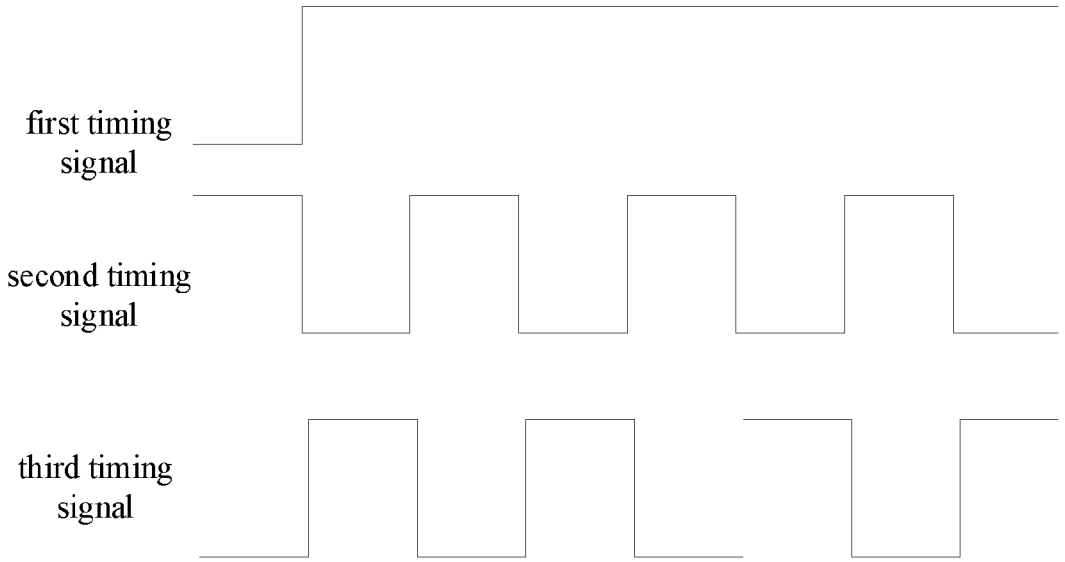
FIG. 5 is a timing diagram of timing signals generated by a programmable logic device provided by a specific implementation of the present invention.

Accordingly, the signal output module 120 comprises three timing signal input terminals 122, and the plurality of timing signal output terminals 131 of the programmable logic device 130 include a first timing signal output terminal for outputting a first timing signal, a second timing signal output terminal for outputting a second timing signal and a third timing signal output terminal for outputting a third timing signal. Timing diagrams of the first timing signal, the second timing signal and the third timing signal are shown in FIG. 5. The first timing signal is used for controlling the signal output module 120 to output the initial signal STV, the second timing signal is used for controlling the signal output module 120 to output the first clock signal CLK1, and the third timing signal is used for controlling the signal output module 120 to output the second clock signal CLK2.

In the implementation in which the signal output module 120 comprises three timing signal input terminals, the signal output module 120 may comprise three analog switches 121.

In the control signal generating circuit 100 provided by the present invention, specific form of the programmable logic device 130 is not particularly limited, for example, the programmable logic device 130 may be a single chip microcomputer. Preferably, the programmable logic device 130 may be a field programmable gate array (FPGA) device, whose output pins are formed as the timing signal output terminals. Since the field programmable gate array device comprise a plurality of output pins, in this case, the programmable logic device 130 can easily output a plurality of timing signals.

Figure 2:
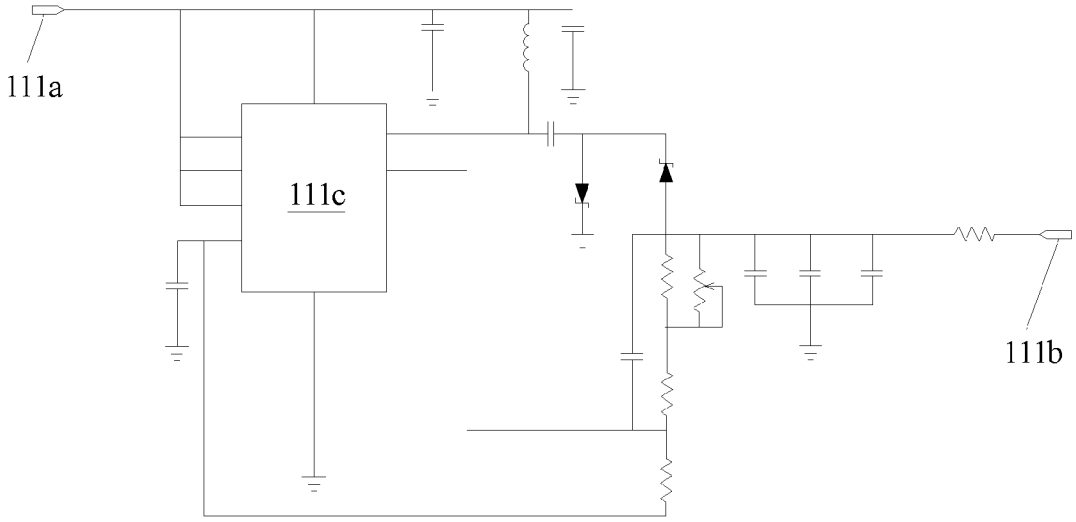
FIG. 2 is a circuit diagram of a first control signal output module in a DC voltage conversion module provided by a specific implementation of the present invention.
Figure 3:
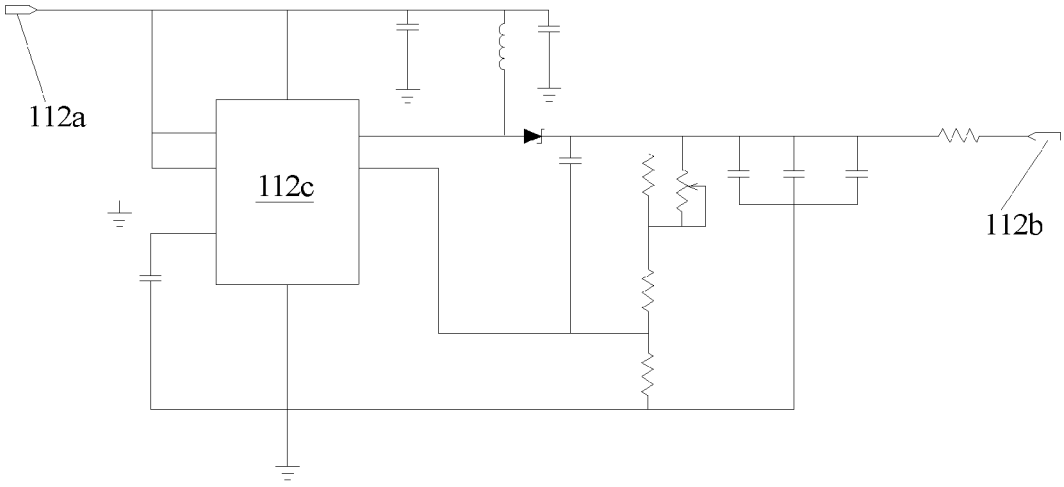
FIG. 3 is a circuit diagram of a second control signal output module in the DC voltage conversion module provided by the specific implementation of the present invention.

In order to facilitate providing the first control signal and the second control signal, preferably, as shown in FIG. 1, the control signal generating circuit 100 may further comprise a DC voltage conversion module 110, which may comprise a first control signal output module 111 (as shown in FIG. 2) for generating the first control signal and a second control signal output module 112 (as shown in FIG. 3) for generating the second control signal. The first control signal output module 111 is connected to the first control signal input terminal of the signal output module 120, and the second control signal output module 112 is connected to the second control signal input terminal of the signal output module 120.

As shown in FIG. 2, the first control signal output module 111 may comprise a first DC voltage input terminal 111*a*, a first DC voltage conversion chip 111*c* and a first control signal output terminal 111*b*. The first DC voltage input terminal 111*a* is connected to a DC power supply, a DC voltage input via the first DC voltage input terminal 111*a* forms the first control signal after converted by the first DC voltage conversion chip 111*c* and electronic components connected with the first DC voltage conversion chip 111*c*, and the first control signal is then output from the first control signal output terminal 111*b*.

As shown in FIG. 3, the second control signal output module 112 may comprise a second DC voltage input terminal 112*a*, a second DC voltage conversion chip 112*c* and a second control signal output terminal 112*b*. The second DC voltage input terminal 112*a* is connected to a DC power supply, a DC voltage input via the second DC voltage input terminal 112*a* forms the second control signal after converted by the second DC voltage conversion chip 112*c* and electronic components connected with the second DC voltage conversion chip 112*c*, and the second control signal is then output from the second control signal output terminal 112*b*.

In the present invention, since the DC voltage conversion module 110 may comprise the first control signal output module 111 which converts a DC voltage into the first control signal (e.g., a low-level signal VGL) and the second control signal output module 112 which converts a DC voltage into the second control signal (e.g., a high-level signal VGH), when the first control signal and the second control signal are used to test the control signal receiving circuit, all that is needed is to switch between the first control signal output module 111 and the second control signal output module 112, no complicated conversion is required (for example, there is no need to use an operational amplifier to generate the first control signal or the second control signal), and in this way, the control signal receiving circuit (e.g., the gate driving circuit in the display device) which needs quick action can be provided with the timing signal required for operation, or can be tested.

In the implementation in which the analog switch 121 is included, as shown in FIGS. 2 to 4, the first control signal output terminal 111*b* of the first control signal output module 111 may be connected to the first control signal input terminal 121*b* of the analog switch 121, and the second control signal output terminal 112*b* of the second control signal output module 112 may be connected to the second control signal input terminal 121*c* of the analog switch 121.

In addition, the first control signal output module 111 can output a stable first control signal, that is, after setting is completed, the first control signal output by the first control signal output module 111 is fixed, and may be a control signal required for operation of the control signal receiving circuit. Moreover, the second control signal output module 112 can output a stable second control signal, that is, after setting is completed, the second control signal output by the second control signal output module 112 is fixed, and may be a control signal required for operation of the control signal receiving circuit. It can be seen that a testing environment provided by the control signal generating circuit 100 and the working environment of the control signal receiving circuit are almost the same, and thus more accurate testing effect can be obtained.

In the specific implementation shown in FIGS. 2 and 3, the first control signal output by the first control signal output module 111 is at a low level (VGL), and the second control signal output by the second control signal output module 112 is at a high level (VGH).

As described above, the control signal receiving circuit may need a plurality of sets of control signals (each of which includes the first control signal and the second control signal) when operating normally. When the first control signals in the respective sets of control signals are the same, and the second control signals therein are also the same, a plurality of sets of the first control signal input terminals and the second control signal input terminals (each set only includes one first control signal input terminal and one second control signal input terminal) of the signal output module 120 are all connected to a same DC voltage conversion module 110 (the first control signal input terminals of the signal output module 120 are all connected to the first control signal output terminal 111*b* of the DC voltage conversion module 110, and the second control signal input terminals of the signal output module 120 are all connected to the second control signal output terminal 112*b* of the DC voltage conversion module 110). For ease of connection, the control signal generating circuit 100 may comprise a plurality of DC voltage conversion modules 110, the plurality of sets of the first control signal input terminals and the second control signal input terminals of the signal output module 120 are in one-to-one correspondence with the plurality of DC voltage conversion modules 110, respectively. That is to say, each DC voltage conversion module 110 is correspondingly connected to one set of the first control signal input terminal and the second control signal input terminal, to which a corresponding set of control signals (including the first control signal and the second control signal) are input.

The control signal generating circuit 100 provided by the present invention can be used to control or test various control signal receiving circuits, and therefore, preferably, the first control signal output by the first control signal output module 111 may be adjusted in a first predetermined range; and/or the second control signal output by the second control signal output module 112 may be adjusted in a second predetermined range. As shown in FIGS. 2 and 3, for this purpose, an adjustable resistor may be respectively provided in the first control signal output module 111 and the second control signal output module 112.

When the control signal generating circuit provided by the present invention is used to test the gate driving circuit in the display device, the first control signal is a high-level signal VGH, the first predetermined range may be from 5V to 20V, the second control signal is a low-level signal VGL, and the second predetermined range may be from −20V to −5V.

The control signal generating circuit 100 provided by the present invention may comprise one signal output module 120, or may comprise a plurality of signal output modules 120. For example, when the control signal receiving circuit is a gate driving circuit of a LCD display panel, since the gate driving circuit is provided at only one side of the LCD display panel, the control signal generating circuit 100 may comprise only one signal output module 120 for providing the gate driving circuit of the LCD display panel with control signals required for operation thereof, or for testing the gate driving circuit of the LCD display panel. When the control signal receiving circuit is a gate driving circuit of an AMOLED display panel (as shown in FIG. 1), two signal output modules 120 are needed, because the gate driving circuits are provided at both sides of the AMOLED display panel, the gate driving circuit at one side is used for providing a scanning signal, and the gate driving circuit at the other side is used for controlling an OLED to emit light. For this reason, two signal output modules 120 are needed to respectively provide control signals required for operation to the gate driving circuits at both sides, or to test the gate driving circuits at both sides.

As another aspect of the present invention, as shown in FIG. 1, there is provided a circuit system which comprises a control signal generating circuit 100 and a control signal receiving circuit (i.e., a gate driving circuit 230 in a display device 200 in FIG. 1), wherein, the control signal generating circuit 100 is the above control signal generating circuit provided by the present invention, and the control signal receiving circuit is electrically connected to an output terminal of a signal output module 120 of the control signal generating circuit 100.

Specifically, the control signal receiving circuit may be the gate driving circuit 230 of the display device 200, and the gate driving circuit 230 comprises an initial signal input terminal 231, a first clock signal input terminal 232 and a second clock signal input terminal 233. In this case, the signal output module 120 of the control signal generating circuit can provide an initial signal STV to the initial signal input terminal 231, provide a first clock signal CLK 1 to the first clock signal input terminal 232 and provide a second clock signal CLK2 to the second clock signal input terminal 233.

As shown in FIG. 1, the display device 200 also comprises a display panel 210 and a source driving circuit 220 for the display panel.

It should be understood by a person skilled in the art that, although the control signal generating circuit and the circuit system provided by the present invention are described by taking the gate driving circuit as the control signal receiving circuit in the present invention, but the present invention is not limited thereto. The control signal generating circuit provided by the present invention can also be used for providing control signals required for operation to a control signal receiving circuit other than the gate driving circuit, or for testing the control signal receiving circuit.

Preferred implementations of the present invention have been described in detail above in conjunction with the accompanying drawings, but the present invention is not limited to the specific details in the above implementations. Various simple modifications can be made to the technical solutions of the present invention within the scope of the technical concepts of the present invention, and these simple modifications all fall within the protection scope of the present invention.

It should also be noted that, the specific technical features described in the above specific implementations can be combined in any appropriate manners without contradiction. To avoid unnecessary repetition, various possible combinations will no longer be otherwise stated in the present invention.

In addition, different implementations of the present invention can also be combined arbitrarily without departing from the teaching of the present invention, and these combinations are also deemed as contents disclosed by the present invention.

The invention claimed is:

1. A control signal generating circuit comprising a signal output module, which comprises an output terminal, a first control signal input terminal for receiving a first control signal and a second control signal input terminal for receiving a second control signal, wherein, the signal output module is capable of selectively outputting the first control signal input from the first control signal input terminal or the second control signal input from the second control signal input terminal to a control signal receiving circuit via the output terminal, wherein the control signal generating circuit further comprises a direct current (DC) voltage conversion module which comprises a first control signal output module for generating the first control signal and a second control signal output module for generating the second control signal, wherein, the first control signal output module is connected to the first control signal input terminal of the signal output module, and the second control signal output module is connected to the second control signal input terminal of the signal output module.

2. The control signal generating circuit according to claim 1, wherein, the signal output module further comprises a timing signal input terminal for receiving a timing signal, and the signal output module selectively outputs, according to the timing signal input from the timing signal input terminal, the first control signal input from the first control signal input terminal or the second control signal input from the second control signal input terminal to the control signal receiving circuit via the output terminal.

3. The control signal generating circuit according to claim 2, wherein, the signal output module comprises at least one analog switch, each analog switch comprises the output terminal, the first control signal input terminal, the second control signal input terminal and the timing signal input terminal, and the output terminal is selectively connected to the first control signal input terminal or the second control signal input terminal according to the timing signal input from the timing signal input terminal.

4. The control signal generating circuit according to claim 2, further comprising a programmable logic device for generating the timing signal, wherein, a timing signal output terminal of the programmable logic device is connected to the timing signal input terminal of the signal output module.

5. The control signal generating circuit according to claim 4, wherein, the signal output module comprises a plurality of timing signal input terminals and a plurality of output terminals, which are in one-to-one correspondence with the plurality of timing signal input terminals, the programmable logic device comprises a plurality of timing signal output terminals, which are respectively connected to the plurality of timing signal input terminals of the signal output module, and the plurality of timing signal output terminals of the programmable logic device are capable of outputting a plurality of timing signals.

6. The control signal generating circuit according to claim 5, wherein, the control signal receiving circuit is a gate driving circuit of a display device, the signal output module comprises three timing signal input terminals, the plurality of timing signal output terminals of the programmable logic device comprise a first timing signal output terminal for outputting a first timing signal, a second timing signal output terminal for outputting a second timing signal and a third timing signal output terminal for outputting a third timing signal, the first timing signal is used for controlling the signal output module to output an initial signal, the second timing signal is used for controlling the signal output module to output a first clock signal, and the third timing signal is used for controlling the signal output module to output a second clock signal.

7. The control signal generating circuit according to claim 5, wherein, the programmable logic device includes a field programmable gate array device, whose output pins serve as the timing signal output terminals.

8. The control signal generating circuit according to claim 1, wherein, the first control signal output module comprises a first DC voltage input terminal, a first DC voltage conversion chip and a first control signal output terminal, the first DC voltage input terminal is connected to a DC power supply, a DC voltage input via the first DC voltage input terminal forms the first control signal after converted by the first DC voltage conversion chip and electronic components connected with the first DC voltage conversion chip, and the first control signal is then output from the first control signal output terminal;

the second control signal output module comprises a second DC voltage input terminal, a second DC voltage conversion chip and a second control signal output terminal, the second DC voltage input terminal is connected to a DC power supply, a DC voltage input via the second DC voltage input terminal forms the second control signal after converted by the second DC voltage conversion chip and electronic components connected with the second DC voltage conversion chip, and the second control signal is then output from the second control signal output terminal.

9. The control signal generating circuit according to claim 1, further comprising a plurality of DC voltage conversion modules, wherein the signal output module comprises a plurality of pairs of first control signal input terminals and second control signal input terminals, and the plurality of DC voltage conversion modules are in one-to-one correspondence with the plurality of pairs of first control signal input terminals and second control signal input terminals of the signal output module, respectively.

10. The control signal generating circuit according to claim 1, wherein, the first control signal output by the first control signal output module is adjustable in a first predetermined range; and/or the second control signal output by the second control signal output module is adjustable in a second predetermined range.

11. The control signal generating circuit according to claim 10, wherein, the first predetermined range is from 5V to 20V, and the second predetermined range is from −20V to −5V.

12. A circuit system, comprising a control signal generating circuit and a control signal receiving circuit, wherein the control signal generating circuit is the control signal generating circuit according to claim 1, and the output terminal of the signal output module of the control signal generating circuit is electrically connected to the control signal receiving circuit.

13. The circuit system according to claim 12, wherein, the control signal receiving circuit is a gate driving circuit of a display device, the gate driving circuit comprises an initial signal input terminal, a first clock signal input terminal and a second clock signal input terminal, the signal output module of the control signal generating circuit is capable of providing an initial signal to the initial signal input terminal of the gate driving circuit, providing a first clock signal to the first clock signal input terminal of the gate driving circuit and providing a second clock signal to the second clock signal input terminal of the gate driving circuit.

14. The circuit system according to claim 12, wherein, the signal output module further comprises a timing signal input terminal for receiving a timing signal, and the signal output module selectively outputs, according to the timing signal input from the timing signal input terminal, the first control signal input from the first control signal input terminal or the second control signal input from the second control signal input terminal to the control signal receiving circuit via the output terminal.

15. The circuit system according to claim 14, wherein, the signal output module comprises at least one analog switch, each analog switch comprises the output terminal, the first control signal input terminal, the second control signal input terminal and the timing signal input terminal, and the output terminal is selectively connected to the first control signal input terminal or the second control signal input terminal according to the timing signal input from the timing signal input terminal.

16. The circuit system according to claim 14, wherein, the control signal generating circuit further comprises a programmable logic device for generating the timing signal, wherein, a timing signal output terminal of the programmable logic device is connected to the timing signal input terminal of the signal output module.

17. The circuit system according to claim 16, wherein, the signal output module comprises a plurality of timing signal input terminals and a plurality of output terminals, which are in one-to-one correspondence with the plurality of timing signal input terminals, the programmable logic device comprises a plurality of timing signal output terminals, which are respectively connected to the plurality of timing signal input terminals of the signal output module, and the plurality of timing signal output terminals of the programmable logic device are capable of outputting a plurality of timing signals.

18. The circuit system according to claim 17, wherein, the control signal receiving circuit is a gate driving circuit of a display device, the signal output module comprises three timing signal input terminals, the plurality of timing signal output terminals of the programmable logic device comprise a first timing signal output terminal for outputting a first timing signal, a second timing signal output terminal for outputting a second timing signal and a third timing signal output terminal for outputting a third timing signal, the first timing signal is used for controlling the signal output module to output an initial signal, the second timing signal is used for controlling the signal output module to output a first clock signal, and the third timing signal is used for controlling the signal output module to output a second clock signal.

* * * * *